United States Patent [19]

Skopek

[11] Patent Number: 4,706,564

[45] Date of Patent: Nov. 17, 1987

[54] ADJUSTABLE STAMP

[76] Inventor: Karl Skopek, Dr. Franz Arming Strasse 5, A-4600 Wels, Austria

[21] Appl. No.: 833,060

[22] Filed: Feb. 24, 1986

[30] Foreign Application Priority Data

Feb. 22, 1985 [AT] Austria ..... 538/85

[51] Int. Cl.[4] ..... B41J 1/20

[52] U.S. Cl. ..... 101/111; 101/405

[58] Field of Search ..... 101/103, 105, 111, 371, 101/373, 405, 406

[56] References Cited

U.S. PATENT DOCUMENTS 4,492,162 1/1985 Nettesheim et al. ..... 101/103

4,561,353 12/1985 Chapman et al. ..... 101/111

*Primary Examiner*—Charles A. Pearson

*Assistant Examiner*—Moshe I. Cohen

*Attorney, Agent, or Firm*—Kurt Kelman

[57] ABSTRACT

An adjustable stamp is provided having at least one loop-shaped type ribbon guided by an adjustment wheel and a support strip, the type set for printing being disposed at the bottom side of the support strip, and a frame plate supporting a printing plate producing a permanent imprint and having a window through which the type disposed on the support strip projects. The frame plate is displaceably supported by means of guide strips leading into the interior of the housing of the stamp and is displaceable by means of a manipulating device connected to the guide strips.

7 Claims, 3 Drawing Figures

ADJUSTABLE STAMP

The present invention relates to an adjustable stamp having at least one loop-shaped type belt guided by means of an adjustment wheel and a support strip, where the type set for printing, which rests against the support strip, projects through a window of a frame plate. The frame plate is provided with a printing plate for forming an imprint surrounding the imprint of the settable or adjustable type, the frame plate being supported on the housing of the stamp in such a way that it is displaceable perpendicularly with respect to the plane of its printing plate.

Adjustable stamps as described above are widely used where an unchanging or permanent instruction is to be printed together with a statement or data that changes, for example the instruction that a document has been received, combined with the date of receipt. The unchanging or permanent instruction or statement may relate to a defined piece of merchandise, or it may be a promotional or advertising imprint, and the adjustable part of the stamp may serve for printing a numerical code or numbering or a feature of the lot of goods or the like. As a rule, the requirement which stamps of this type must satisfy is that the area available on the frame plate of the stamp for the permanent imprint must be as close as possible to the imprint of the adjustable type of the stamp. In order to satisfy this requirement, the adjustable type arranged on the loop-shaped type belts are designed relatively thick, so that the support strip comes to rest above the frame plate. In this way, the window of the frame plate is able to closely enclose the type set in the printing position on the loop-shaped type belts, so that a printing plate provided with the permanent imprint of the stamp is capable of coming very close to the adjustable type of the stamp present in the printing position. However, such a design requires that the frame plate be moved out of its printing position when the type disposed on the loop-shaped type belts are to be adjusted or set. In order to permit this movement of the frame plate out of the printing position, the plate is frequently provided with a pivotable support or bearing with a hinge arranged on the edge of the plate. However, the unilateral fixing of the position of the frame plate resulting from this design is unfavorable in view of the adjustment of the position of the frame plate for compensating for tolerances of the printing plates, and such unilateral pivotable support of the frame plate often also leads to damage of the adjustable type in their printing position when the frame plate is swung into position, such as when the adjustable type are not exactly positioned on the support strip.

In a known stamp of the above described type, the frame plate is provided with two side pieces which laterally enclose the housing of the stamp and which support resilient attachments which engage corresponding openings provided on the sides of the housing of the stamp so as to arrest the frame plate on the housing. This guidance and fixation of the frame plate provided by the side pieces require careful control by the operator when the plate is moved out of its printing position and returned to this position. In addition, this construction tends to cause jamming and inadequate support of the frame plate in its printing position. Furthermore, with such a stamp, the manufacturing tolerances of the printing plate and type have a highly unfavorable effect.

It is an object of the present invention to provide an adjustable stamp of the above described type which is simple in design and which overcomes the problems associated with prior art adjustable stamps. The adjustable stamp according to the present invention permits a safe and precise displacement of the frame plate from its printing position and a safe and precise return into the printing position without requiring any special care on the part of the operator when controlling the stamp. In addition, the stamp according to the present invention permits compensation for manufacturing tolerances as well as looseness resulting from long use of the stamp.

The stamp according to the present invention includes a frame plate having guide strips or guide bars on both sides of the window which project upwardly vertically from the plane of the frame plate and which are slidably guided in the interior of the housing in order to permit displacement of the frame plate from a first position intended for printing action of the stamp, in which position one type of the type belt projects through the window, into a second "pushed out" or extended position, in which the type belt is freely adjustable. There is also provided a manipulating means connected with the guide strips or bars which serves to displace the guide strips or bars and which projects outwardly from the housing. By guiding the frame plate by means of guide strips slidably guided in the interior of the housing of the stamp, it is possible to achieve a practically jam-free and precise displacement of the frame plate, so that the plate can always be pushed into its printing position precisely. This results in the window provided in the frame plate effecting a precise positioning of the adjustable type while the frame plate is being pushed into its printing position without the danger of any damage to the adjustable type. The means for manipulating the motion of the frame plate which is connected to the guide strips or bars, avoids direct application of the displacement forces to the guide strips and thus prevents unwanted bending of the strips or bars even without careful handling or manipulation. This means is also effective in the sense of maintaining an exact function and in the sense of avoiding jamming, and furthermore protects against unintentional contact with the printing ink-carrying printing plate in the course of the manipulation required for adjustment of the stamp.

With the stamp according to the present invention it is preferable that the support strip and the adjustment wheel or wheels, by means of which the type belt or type belts are guided, are arranged on a support which is vertically adjustable in the housing of the stamp with respect to the plane of the frame plate. With the design according to the present invention it is possible to achieve the afore-mentioned objectives. In a simple manner the design compensates for tolerances in the thickness of the adjustable type and printing plate and even for tolerances in the components of the stamp, so that it is always possible to achieve uniform printing.

One preferred embodiment of the stamp, which permits the movement of the frame plate from its printing position and the return to the printing position in an economically simple manner and which is of simple construction, includes at least one lever for displacing the frame plate. This lever is pivotably supported in the housing adjacent to and engaging a guide strip or bar and connected to a manipulating means. In order to achieve a substantially jam-free sliding motion of the frame plate in combination with a simple and easily operable construction, it is preferable to provide two levers formed by the two legs of a U-shaped yoke. Each of the levers is supported at its free end in the housing adjacent to a guide strip of the frame plate and projects outwardly at its side facing the base of the yoke, the base of the U-shaped yoke supports or forms the manipulating means. With such a design, it is preferable for simple and trouble-free assembly and also for an operationally safe connection over long periods, if the guide strips are provided with a transverse groove or keyway which is engaged by the associated lever.

A pin-and-oblong-hole-type or pin-slotted hole-type connection is another possibility for producing or obtaining an active connection of the lever with an associated guide strip or guide bar. Another advantageous embodiment involves the use of an eccentric for displacing the frame plate, at least one eccentric being provided seated on a shaft supporting a manipulating means and extending transversely to the guide strips or bars and which cooperates with counter surfaces provided on the guide strip or bar associated with the eccentric.

In the stamp according to the present invention, if the type belts are arranged on an adjustable support, it is advantageous if the support is supported in guide rails, guide keyways or grooves or the like in such a way that the support is vertically displaceable with respect to the plane of the frame plate. For adjusting the position of the support, a screw spindle may be disposed perpendicular to the plane of the frame plate having an adjusting disk cooperating therewith projecting from the housing of the stamp. Thus, it is possible in a very simple manner to achieve an exact vertical adjustment of the support with respect to the frame plate with the use of only a single adjustment element. In this connection, simple design and ease of control are achieved if the screw spindle is disposed on the support on the geometric longitudinal axis of the support, and if the adjusting disk is a knurled nut. In view of the design of the guides of the support it is advantageous, furthermore, if the guide strips or bars of the frame plate engage guide rails or guide keyways or grooves or the like on the one side which are disposed on the inner side of the housing, and engage guide rails or grooves or the like provided on the support on the other side, with the guide strips or bars extending parallel to the guide rails or grooves which are disposed on the housing. This design permits a simple construction having a very compact structure in which dead spaces are substantially avoided.

Other objects and features of the present invention will become apparent from the following detailed description considered in connection with the accompanying drawings. It is to be understood, however, that the drawings are designed as an illustration only and not as a definition of the limits of the invention.

In the drawings wherein similar reference characters denote similar elements throughout the several views.

Figure 1:
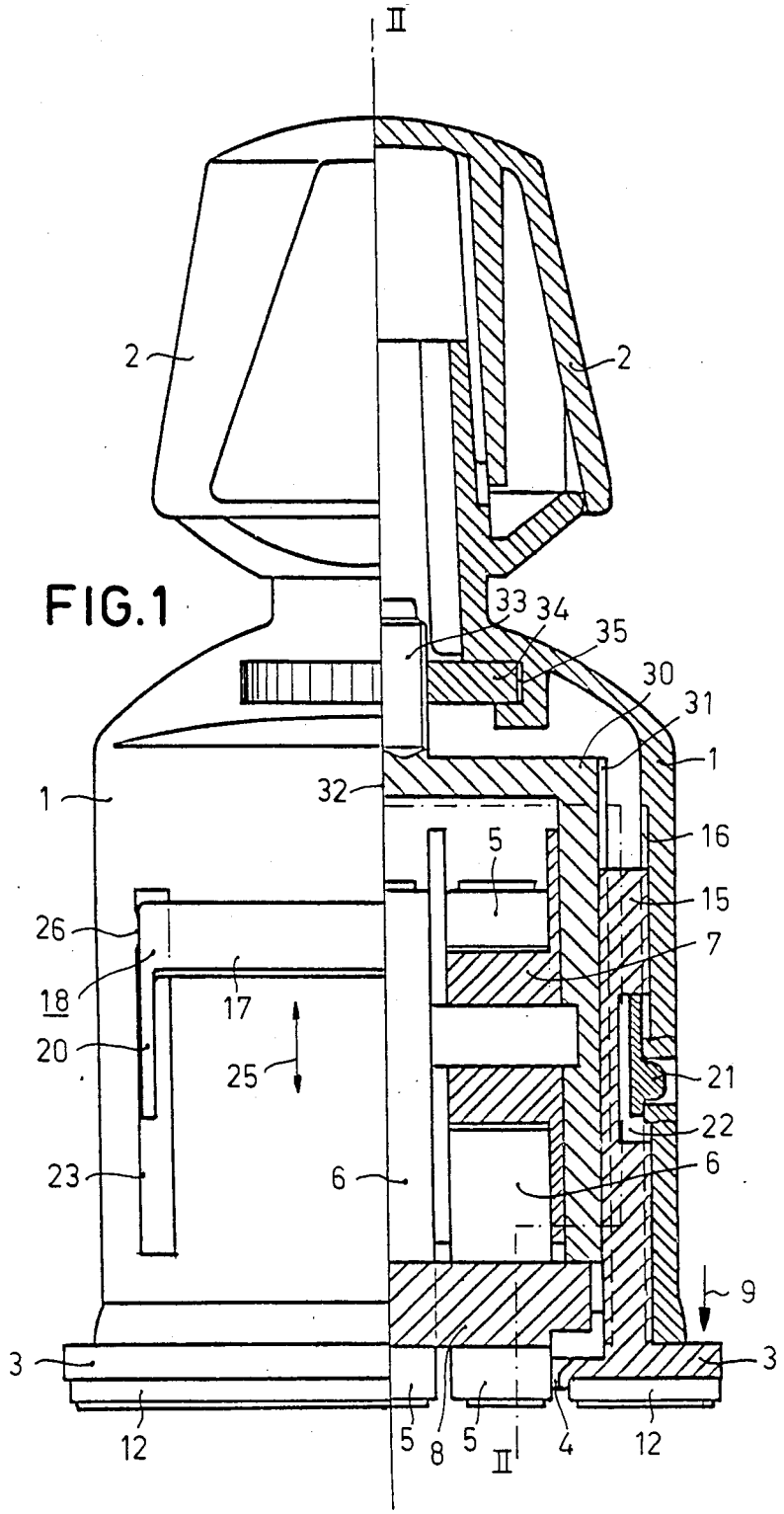
FIG. 1 is a front elevational view of a stamp according to the present invention showing a cross-sectional view of half thereof.

Now turning to the drawings, therein is shown a stamp having a housing 1 supporting on its top side a handle 2. A frame plate 3 is arranged on the bottom side of housing 1 and is provided with a window 4 in which a plurality of adjustable printing type 5 are placed. Printing type 5 are seated on type belts 6 each of which is guided by means of an adjustment wheel 7 and a support strip 8. When a type 5 is set for printing it rests against support strip 8 and projects through window 4 of frame plate 3. By turning adjustment wheel 7 associated with the respective type belt 6, the type of the individual type belts which is intended for printing is brought into the printing position on support strip 8. Window 4 encloses or surrounds the type 5 in their printing positions with a small clearance therebetween, which means that frame plate 3 must be moved or displaced from the position shown in FIGS. 1 and 2 into the position shown in FIG. 3 in order to permit such an adjustment movement of type 5. This displacement is achieved by pushing or extending frame plate 3 out in the direction indicated by arrow 9 in FIG. 1. When frame plate 3 is in the position shown in FIG. 3, type belts 6 with type 5 seated thereon can be freely adjusted or set by turning adjustment wheels 7 accordingly. Since window 4 of frame plate 3 surrounds type 5 disposed on support strip 8 with a relatively small clearance therebetween, this effects by means of plate 3 a correction of any slightly inclined or oblique position of type 5 resting on the support strip when frame plate 3 is pushed back in the direction of arrow 10 (FIG. 3) into the position shown in FIGS. 1 and 2. Such correction is promoted by a bevel 11 at the top edge of window 4, as clearly seen in FIG. 3.

A printing plate 12 is mounted on the bottom side of frame plate 3 for producing a permanent imprint which surrounds the imprint of adjustable type 5. Since window 4 surrounds type 5 with a small clearance, the symbols of printing plate 12 may be placed with a small clearance from type 5.

Figure 2:
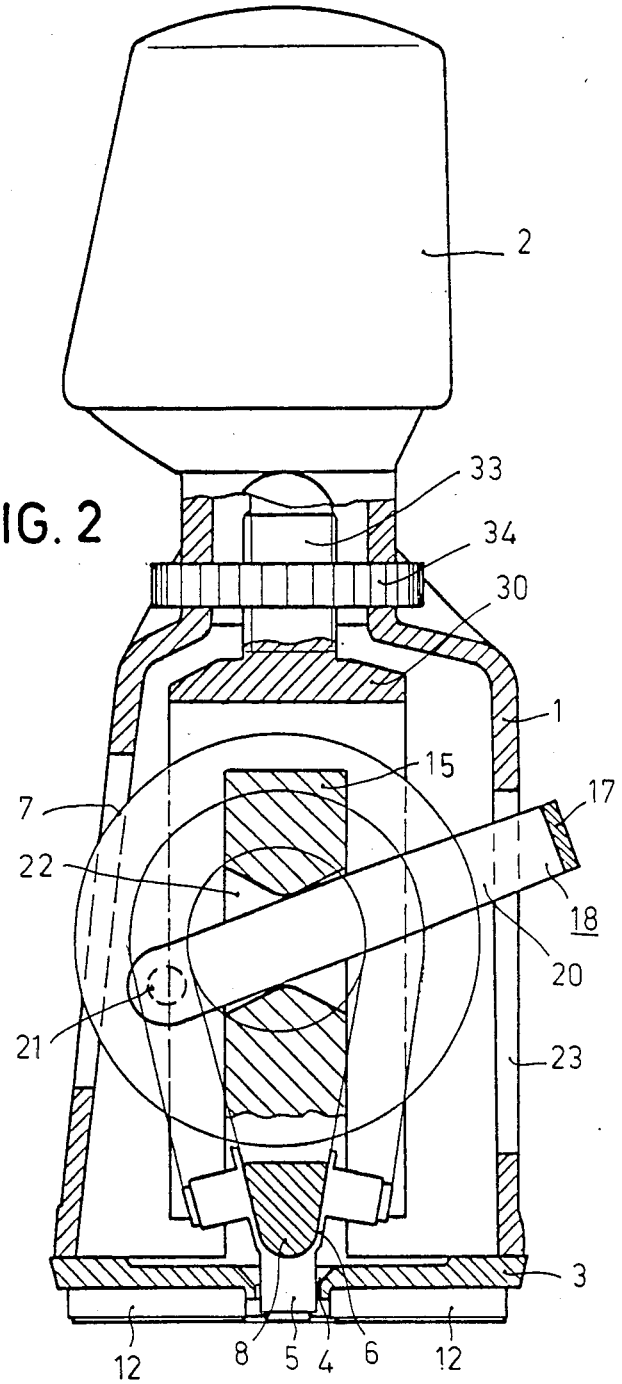
FIG. 2 is a cross-sectional view of the stamp of FIG. 1 taken along line II—II of FIG. 1.
Figure 3:
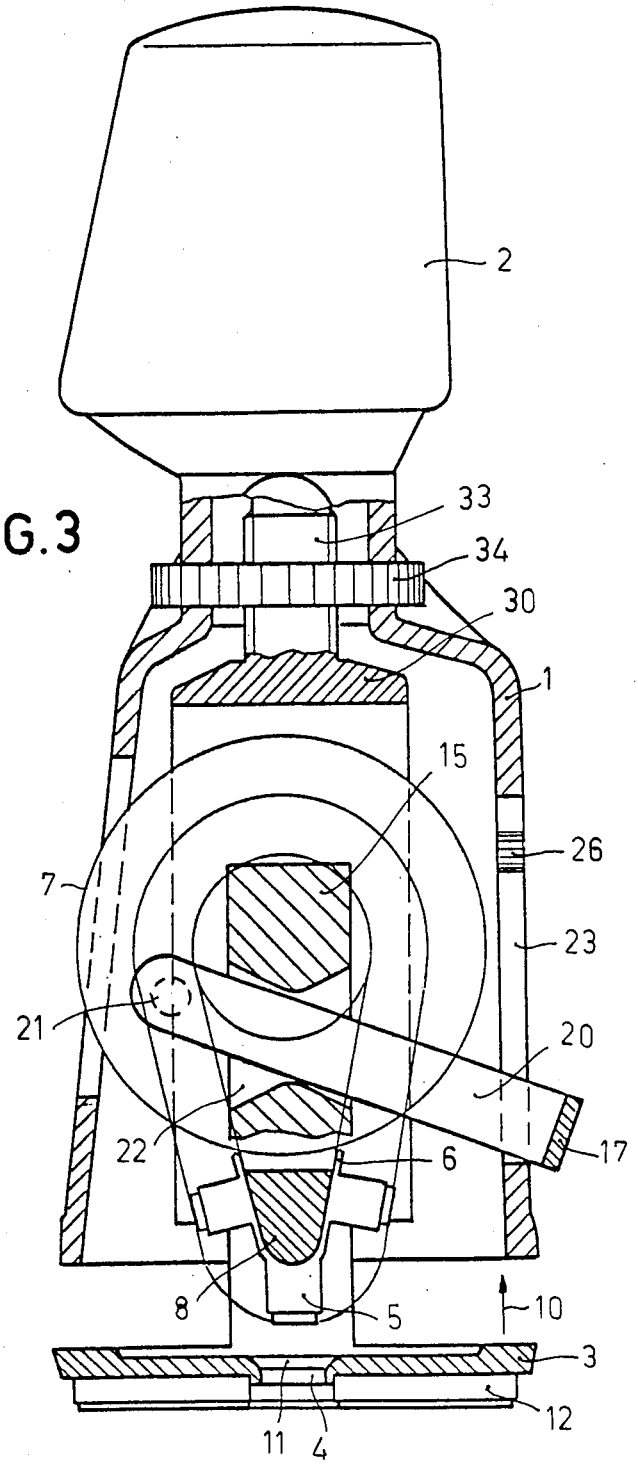
FIG. 3 is a cross-sectional view of the stamp similar to FIG. 2 with the frame plate in the pushed-out or extended position.

In order to permit the displacement of frame plate 3 from the printing position shown in FIGS. 1 and 2 into the position shown in FIG. 3 and back again, frame plate 3 is provided with guide strips 15, which project upwardly from frame plate 3 vertically with respect to the plane thereof. Guide strips 15 are slidably guided in the interior of housing 1 and engage guide grooves 16 formed on the inside of housing 1.

For effecting displacement of frame plate 3, a manipulating means 17 is arranged extending to the outer side of housing 1 of the stamp and connected with guide strips 15. By moving manipulating means 17 up and down, frame plate 3 is extended and returned.

In the embodiment shown, manipulating means 17 is in the form of a U-shaped yoke 18, whereby the two legs 20 of the yoke form levers adjacent to and engaging guide strips 15. Legs 20 are pivotably supported in housing 1 of the stamp on pivots 21. For this purpose, guide strips 15 are provided with a transverse keyway or groove 22, in which the associated lever formed by a leg 20 of U-shaped yoke 18 rests. Legs 20 extend outwardly through slots 23 provided in housing 1. By simply moving manipulating means 17 up and down in the sense of the double arrow 25 (FIG. 1), frame plate 3 is moved out of its printing position shown in FIG. 1 and into the position shown in FIG. 3, and returned again to the printing position shown in FIG. 1. A locking or arresting nose 26 is provided on the edge of one or both slots 23 for arresting manipulating means 17 in the top position shown in FIG. 1.

Adjustment wheels 7 and support strip 8, by means of which type belts 6 are guided, are arranged on a support 30. Support 30 is supported in housing 1 in such a way that it is slidable vertically with respect to the plane of frame plate 3 and adjustable with respect to printing plate 12 so as to adjust the level or position of the height of type 5 disposed on support strip 8. For forming the displaceable support of support 30, the shown example of support 30 is provided with guide grooves 31 which are engaged by guide strips 15 of frame plate 3. A screw spindle 33 arranged on the geometric longitudinal axis 32 of support 30 permits the adjustment of support 30 by means of adjustment disk 34 which is threadably engaged with screw spindle 33. Adjustment disk 34, which is provided in the form of a knurled nut, projects from housing 1 through window slots 35 and, in this way, may be easily seized and turned in order to adjust support 1 and thus type 5 in the desired position.

The various guide means provided with the stamp of the invention may be readily modified within the framework of the invention as compared to the embodiment shown by way of example in the drawing. For example, guide rails or guide ribs may be provided instead of guide grooves 16 and 31, which are engaged by guide strips 15 provided on frame plate 3, in which case the guide rails or guide ribs engage matching grooves or recesses in guide strips 15. Furthermore, instead of the guide strips 15, guide bars may be provided on frame plate 3, which bars may have, for example a round section. Also, support 30 may be supported in housing 1 independently of the bearing of guide strips 15 by providing support 30 with its own guide rails or guide grooves disposed on the inside of the housing. For displacing guide strips 15 provided on frame plate 3, individual levers cooperating with the strips or bars may be provided, the levers being seated on a common shaft which extends through the housing and projects outwardly and which bears the manipulating means, or, if need be, one single lever may be used for the purpose of providing said displacing. Also, a pin-and-oblong-hole-type coupling is suitable for forming the active connection of the lever or levers with the associated guide strips or bars, in which case a transverse pin is provided on the guide strip or guide bar which engages an oblong hole on the lever, or in which case the guide strip or bar has a transversely extending oblong hole or transverse slot which is engaged by the pin arranged on the respective lever. Another advantageous possibility for adjusting the frame plate is to provide one or two eccentrics, which are arranged in the interior of the housing on an outwardly extending shaft which supports a manipulating means in the form of a button or lever, whereby the eccentrics cooperate with counter surfaces provided on the guide strips or bars, the counter surfaces having the form, for example of a link opening or link slot. With this design, the shaft supporting the eccentrics may extend through the space which is surrounded by the type belts, if need be. Also, the screw spindle provided for adjusting support 30 may be screwed into a thread provided on support 30, and said screw spindle itself may be rigidly connected with the adjustment disk by means of which it is turned. With another modification, a hidden screw may be provided for adjusting support 30 which is accessible after handle 2 has been removed, or it may be accessible by way of a suitable opening provided in handle 2 or in housing 1.

While only a single embodiment of the present invention has been shown and described, it will be obvious that many changes and modifications may be made thereunto without departing from the spirit and scope of the invention.

What is claimed is:

1. In an adjustable stamp having a housing, a frame plate having a window therein, at least one loop-shaped adjustable type belt having printing characters projecting therefrom and guided by an adjustment wheel and a support strip, the adjustable type selected for printing being disposed on the support strip and projecting through said window of said frame plate, said frame plate including a printing plate for producing an imprint surrounding the imprint of the adjustable type and being supported on the housing of the stamp so that it is displaceable vertically with respect to its plane, the improvement comprising:

guide strips connected to said frame plate on each side of the window, said guide strips being displaceable vertically with respect to the plane of the frame plate and slidably guided in the interior of the housing so that said frame plate is displaceable from a first printing position, in which position a type of the type belt projects through the window into a second, extended position, in which said type belt is freely adjustable; and manipulating means projecting outwardly through said housing connected to said guide strips for displacing said guide strips.

2. The adjustable stamp as defined in claim 1, wherein said manipulating means comprises at least one lever extending through said housing for displacing said frame plate, said lever being pivotably supported in said housing adjacent to and operatively engaging a guide strip.

3. The adjustable stamp as defined in claim 1, wherein said manipulating means comprises two levers formed by the two legs of a U-shaped yoke for displacing said frame plate, each of said two legs being pivotably supported in said housing adjacent to and operatively engaging each of said guide strips and extending outwardly through said housing with its side facing the base of said yoke, the base of said U-shaped yoke forming said manipulating means.

4. The adjustable stamp as defined in claim 3, wherein said guide strips are each provided with a transverse groove which is engaged by the respective lever.

5. The adjustable stamp as defined in claim 1, which further comprises a support adjustably supported for displacement vertically with respect to the plane of said frame plate, said support having arranged thereon said type belt, a screw spindle disposed vertically with respect to the plane of said frame plate having said support mounted for adjustable displacement thereon, and an adjustment disk rotatably supported in the housing of the stamp cooperating with said screw spindle and projecting with its edge from the housing of the stamp for the vertical adjustment of said support.

6. The adjustable stamp as defined in claim 5, wherein said guide strips of said frame plate, on the one side, engage guide rails disposed on the inside of said housing, and, on the other side, engage guide rails provided on said support, and extend parallel to the guide rails disposed on the housing.

7. The adjustable stamp as defined in claim 1, wherein said support strip and said adjustment wheel by means of which said type belt is guided, are disposed on a support which is arranged in said stamp housing and is adjustable vertically with respect to the plane of said frame plate so as to adjust the vertical position of the adjustable type.

* * * * *